United States Patent [19]

Polen

[11] 4,214,664

[45] Jul. 29, 1980

[54] CRANE SAFETY REEVING

[75] Inventor: Karl L. Polen, Alliance, Ohio

[73] Assignee: The Alliance Machine Company, Alliance, Ohio

[21] Appl. No.: 936,586

[22] Filed: Aug. 24, 1978

[51] Int. Cl.[2] ..... B66C 17/06

[52] U.S. Cl. ..... 212/142.1; GH 254/285

[58] Field of Search ..... 414/560, 561; 212/10–16, 18–27; 254/184, 188, 144

[56] References Cited

U.S. PATENT DOCUMENTS

| | | | |
|---|---|---|---|
| 1,469,123 | 9/1923 | Taylor | 212/11 |
| 3,770,136 | 11/1973 | Fischer | 212/10 |
| 3,786,935 | 1/1974 | Vlazny et al. | 212/11 |
| 4,069,921 | 1/1978 | Raugulis et al. | 254/184 X |
| 4,094,493 | 6/1978 | Polen | 212/14 X |

*Primary Examiner*—Stephen G. Kunin
*Assistant Examiner*—Terrance L. Siemens
*Attorney, Agent, or Firm*—Buell, Blenko & Ziesenheim

[57] ABSTRACT

A two drum or similar take-up crane hoist is provided having an intermediate sheave deck between the crane trolley and a lift beam and a combination of vertical and cross-over reeving over the sheave deck so as to support both ends of the lift beam from each of the take-up means separately.

10 Claims, 3 Drawing Figures

CRANE SAFETY REEVING

This invention relates to crane safety reeving and particularly to safety reeving for a two girder ladle crane or the like. In the case of two drum cranes, such as ladle cranes, only the high speed drive shaft for the two drums is mechanically tied together. This high speed shaft, having a single motor or brake, is such that one drum cannot run away but is always tied to the other drum. The slow speed drive on the two drums, on the other hand, is normally accomplished by two synchronous motors driving the two drums through separate shafts. In the event of a failure of one drum drive there is nothing to tie the two drums together and one can run away independently of the other with serious consequences both in human and mechanical losses.

The present invention provides a structure which solves this problem of independent drive drums by a relatively simple and inexpensive structure. This invention provides a reeving structure which ties together the two drums so that in the event of failure stability is maintained. While the invention is particularly described in the context of a two girder ladle crane, it is applicable to any crane having two independently driven drums lifting a common load.

According to this invention there is provided in an overhead crane having a traveling trolley, spaced apart cable drums on said trolley, separate drive means for each of said cable drums, a lift beam suspended below and movable relatively to the traveling trolley, cable sheaves on the trolley and lift beam, cables fixed at one end to each of the drums and at the other to the lift beam, an intermediate sheave deck between the traveling trolley and lift beam, sheaves on said intermediate sheave deck, said cables on each drum being reeved in part between sheaves on the trolley and sheaves immediately below the trolley on the lifting beam and in part between sheaves on the trolley and across the intermediate sheave deck, over sheaves on the sheave deck and around sheaves on the lift beam immediately below the opposite drum, whereby each drum lifts on both sides of the lift beam. The cables on each drum may be a single multi-reeved cable or a plurality of cables separately reeved. Preferably the intermediate sheave deck is suspended central of and below the main frame on the traveling trolley.

In the foregoing general description of this invention, certain objects, purposes and advantages of the invention have been set out. Other objects, purposes and advantages of this invention will be apparent from a consideration of the following disclosure and the accompanying drawings in which.

Figure 1:
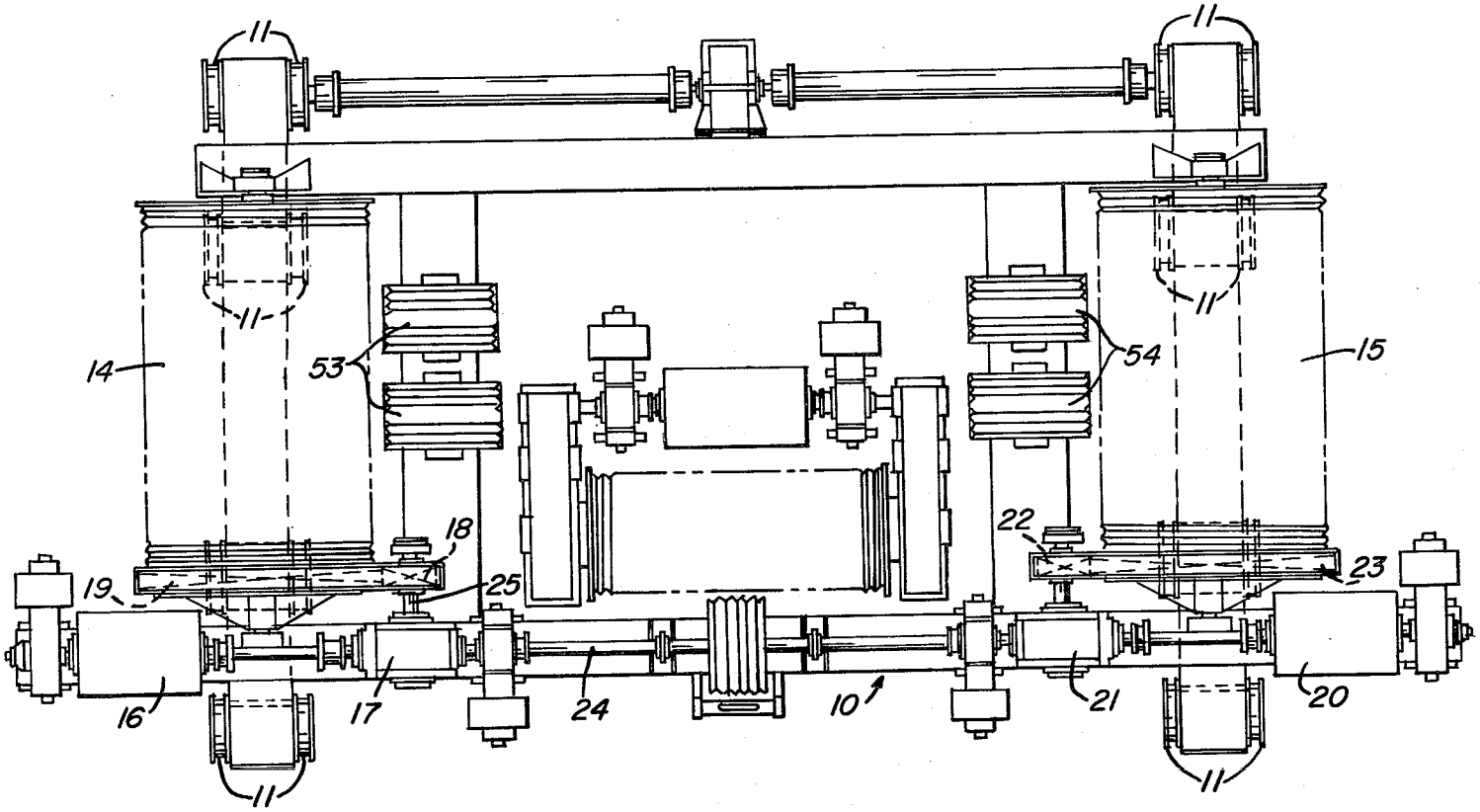
FIG. 1 is a top plan view of an overhead crane trolley incorporating this invention.
Figure 2:
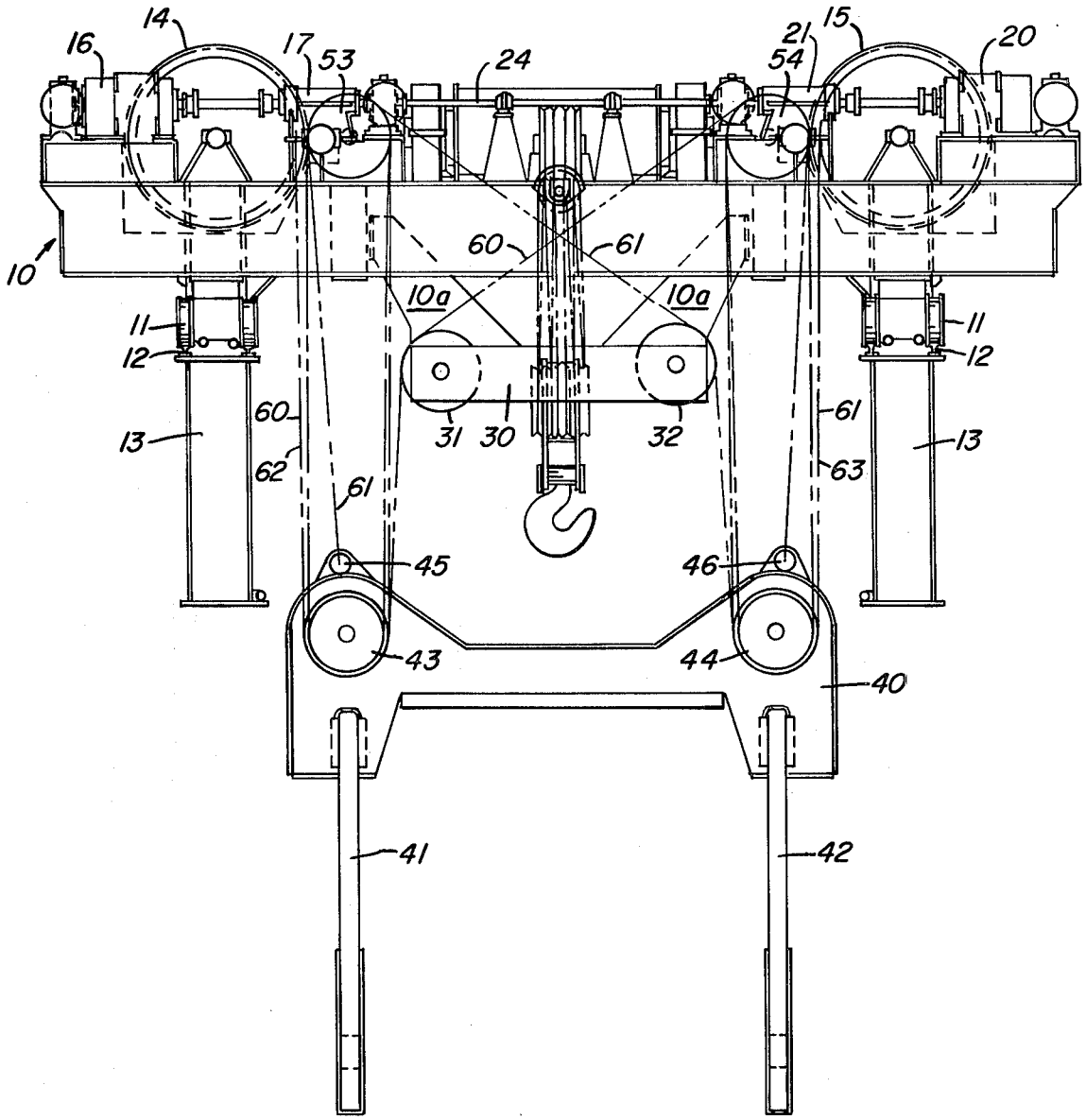
FIG. 2 is an end elevational view of the crane of FIG. 1.
Figure 3:
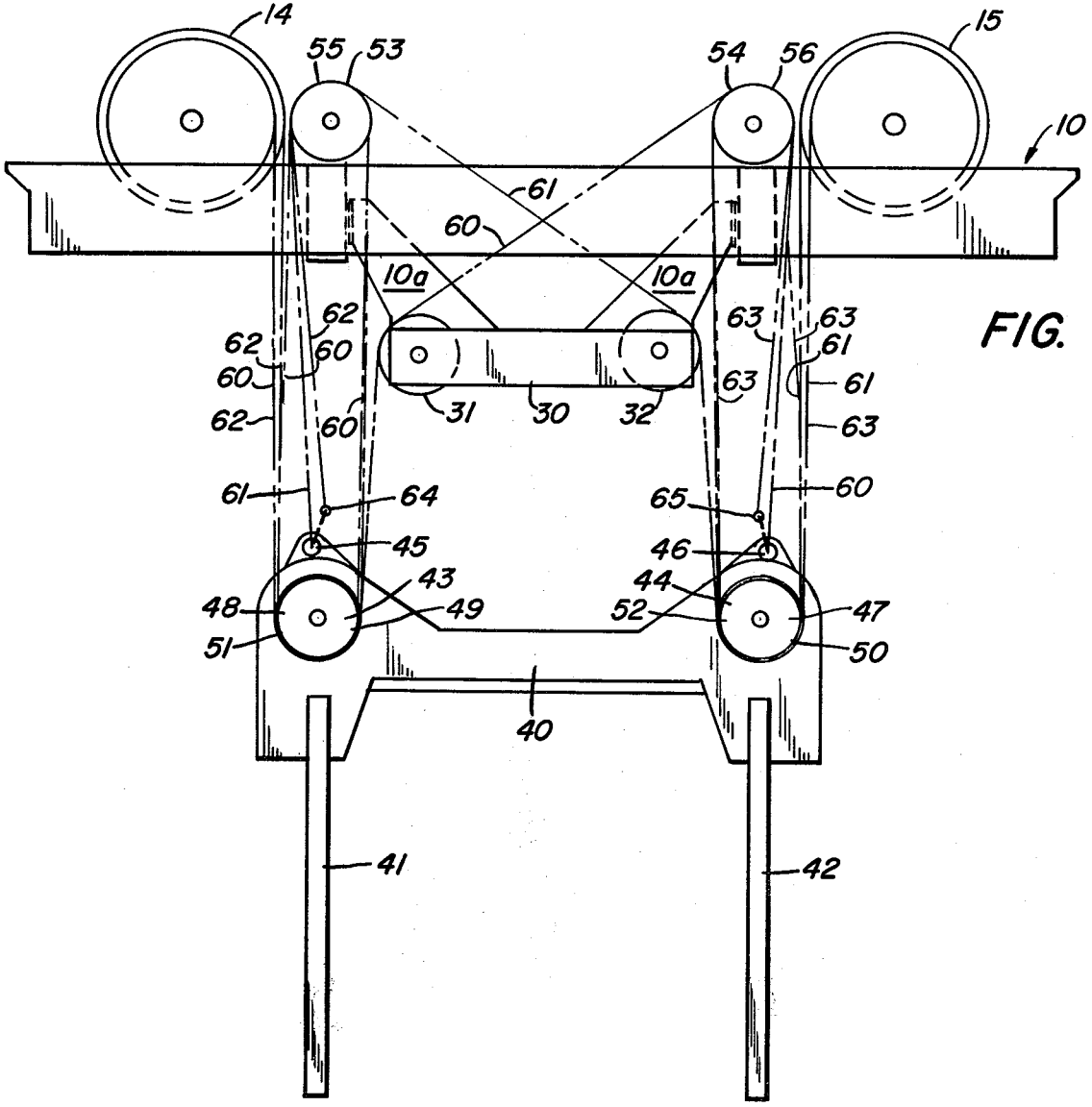
FIG. 3 is a schematic view of the reeving according to this invention.

Referring to the drawings, there is illustrated a traveling crane trolley 10 mounted on drive wheels 11 traveling on rails 12 on a main bridge 13 fixed to a building framework. A first cable drum 14 is journaled on one side of trolley 10 and a second drum 15 is journaled on the other side of trolley 10. Drum 14 is driven by motor 16 and worm gear box 17, through pinion and gear 18 and 19. Drum 15 is driven by motor 20 and worm gear box 21, through pinion and gear 22 and 23. For high speed synchronization, worm gear box 17 and box 21 are interconnected by shaft 24. This connection provides no safety if a failure occurs to either of the slow speed shafts 25 and 26 connecting worm gear boxes 17 and 21 to their corresponding drums 14 and 15. All of the foregoing is conventional in cranes of this type.

An intermediate sheave deck 30 is suspended from trolley 10 by diagonal arms 10*a*. Deck 30 carries sets of sheaves 31 and 32 on opposite sides of deck 30.

A lift beam 40 is provided beneath sheave deck 30 and carries lift hooks 41 and 42 at opposite ends for engaging the trunnions of a ladle, not shown. Lift beam 40 is provided with sheave sets 43 and 44 at opposite ends and a dead end fastener 45 and 46 at each of the opposite ends.

Cable 62 is fixed at one end to drum 14 and at the other end to dead end fastener 64 on the lift beam 40. Cable 60 is reeved over and around sheaves 53 on one end of the traveling trolley adjacent drum 14 and the sheaves 43 and 48 on the lift beam for approximately 25% of the cable reeving. For the balance of the reeving the cable 60 is carried from sheave 49 diagonally over the sheave 31 on sheave deck 30 to sheaves 54 on the opposite side of traveling trolley 10 then to sheaves 47, back over sheave 54 so that the total up and down reeving of cables 60 and 62 is the same and dead end 46 on the lift beam. By this arrangement both sides of the lift beam are reeved from drum 14. Cables 61 are fixed at one end to drum 15 and at the other end to dead end fastener 65 on the lift beam after passing around sheaves 47 and 54. Cables 63 are fixed at one end to drum 15 and at the other end to dead end fastner 45 on the lift beam, after passing around sheaves 52, around sheaves 53 and 51 in the reverse manner to cable 60.

The four sets of cable reeving, from drums 14 and 15, thus each individually support both sides of the lift beam. As a result, a failure at either drum will not cause one side of the beam to fall as has been the case in the past. On the contrary, both sides of the beam will be supported by the remaining drum.

In the foregoing specification, certain preferred practices and embodiments of this invention have been set out, however, it will be understood that this invention may be otherwise embodied within the scope of the following claims.

I claim:

1. An overhead crane comprising a traveling trolley, spaced apart cable take-up means on said trolley, separate drive means for each cable take-up means, a lift beam suspended below and movable vertically relatively to the traveling trolley, at least four cables, two connected to be taken up by one take-up means and the other two connected to be taken up by the other take-up means, a first set of sheaves on the trolley adjacent said one take-up means, a second set of sheaves on the trolley adjacent the other take-up means, a third and a fourth set of sheaves respectively at opposite ends of the lift beam, an intermediate sheave deck depending from said trolley, a fifth and sixth set of sheaves respectively at opposite ends of said sheave deck intermediate the first and third and second and fourth sets of sheaves respectively, said two cables having one cable being reeved in part around said first and third sets of sheaves and dead ending on said lift beam adjacent said third sheaves and the other cable reeved in part around said third set of sheaves and around said second and fourth sets of sheaves to dead end on said lift beam adjacent the fourth set of sheaves, and the other two cables having one cable being reeved in part around said second and fourth sets of sheaves and dead ending on said lift beam adjacent said fourth sheaves and the other cable reeved in part around said fourth set of sheaves and around said first and third sets of sheaves whereby both ends of the lift beam are in part suspended from each of the two take-up means, each of said take-up means having an equal vertical reeving.

2. An overhead crane as claimed in claim 1 wherein the take-up means are cable drums.

3. An overhead crane as claimed in claim 2 wherein one end of one cable is fixed to one drum and the other end to one end of the lift beam and one end of the other cable is fixed to the other drum and the other end to the opposite end of the lift beam.

4. An overhead crane as claimed in claim 1 wherein the intermediate sheave deck is suspended from the traveling trolley by diagonal arms fixed to each of the bridge and deck.

5. An overhead crane as claimed in claim 1 wherein about 25% of the length of said one cable is reeved around the first and third sets of sheaves and about 25% of the length of the other cable is reeved around the second and fourth sets of sheaves.

6. In an overhead crane having a traveling trolley, spaced apart cable take-up means at opposite ends of said trolley, separate drive means for each cable take-up means, a lift beam below and vertically movable relatively to the traveling trolley, at least two cables, one connected to be taken up by one take-up means and the other connected to be taken up by the other take-up means, a first set of sheaves on the trolley adjacent said one take-up means, a second set of sheaves on the trolley adjacent said other take-up means, and a third and a fourth set of sheaves respectively at opposite ends of the lift beam, the improvement comprising an intermediate sheave deck depending from said trolley, a fifth and a sixth set of sheaves respectively at opposite ends of said sheave deck intermediate the first and third and second and fourth sets of sheaves respectively, said one cable being reeved in part around said first and third sets of sheaves and in part around said first and fourth sets of sheaves and over said sixth set of sheaves, and the other cable being reeved in part around said second and fourth sets of sheaves and in part around said second and third sets of sheaves and over said fifth set of sheaves whereby both ends of the lift beam are in part suspended from each of the two take-up means.

7. An overhead crane as claimed in claim 6 wherein the take-up means are drums.

8. An overhead crane as claimed in claim 7 wherein one end of one cable is fixed to one drum and the other end to one end of the lift beam and one end of the other cable is fixed to the other drum and the other end to the opposite end of the lift beam.

9. An overhead crane as claimed in claim 6 wherein the intermediate sheave deck is suspended from the traveling trolley by diagonal arms fixed to each of the bridge and deck.

10. An overhead crane as claimed in claim 6 wherein about 25% of the length of said one cable is reeved around the first and third sets of sheaves and about 25% of the length of said other cable is reeved around the second and fourth sets of sheaves.

* * * * *